US006877247B1

(12) United States Patent
DeMoore

(10) Patent No.: US 6,877,247 B1
(45) Date of Patent: Apr. 12, 2005

(54) POWER SAVING AUTOMATIC ZONED DRYER APPARATUS AND METHOD

(76) Inventor: Howard W. DeMoore, 10954 Shady Trail, Dallas, TX (US) 75220

( * ) Notice: Subject to any disclaimer, the term of this patent is extended or adjusted under 35 U.S.C. 154(b) by 645 days.

(21) Appl. No.: 09/645,759

(22) Filed: Aug. 25, 2000

(51) Int. Cl.[7] ..... F26B 3/34

(52) U.S. Cl. ..... 34/269; 34/273; 101/487; 101/488; 101/424.1; 101/419

(58) Field of Search ..... 101/424.1, 419, 101/487, 488; 34/266, 269, 273

(56) References Cited

U.S. PATENT DOCUMENTS

| | | | |
|---|---|---|---|
| 3,900,959 | A | 8/1975 | Breschi et al. |
| 4,233,901 | A | 11/1980 | Mallinson |
| 4,257,172 | A | 3/1981 | Townsend |
| 4,434,562 | A | 3/1984 | Bubley et al. |
| 4,449,453 | A | 5/1984 | Staffer et al. |
| 4,501,072 | A | 2/1985 | Jacobi, Jr. et al. |
| 4,513,516 | A | 4/1985 | Bjornberg |
| 4,545,131 | A | 10/1985 | Ericsson |
| 4,596,935 | A | 6/1986 | Lumpp |
| 4,693,013 | A | 9/1987 | Pabst et al. |
| 4,698,767 | A | 10/1987 | Wensel et al. |
| 4,703,153 | A | 10/1987 | Pelonis |
| 4,716,658 | A | 1/1988 | Jacobi, Jr. |
| 4,727,655 | A | 3/1988 | Jacobi, Jr. |
| 4,756,091 | A | 7/1988 | Van Denend |
| 4,798,007 | A | 1/1989 | Eichenlaub |
| 4,798,960 | A | 1/1989 | Keller et al. |
| 4,809,608 | A | 3/1989 | Wolnick et al. |
| 4,811,493 | A | 3/1989 | Burgio, Jr. |
| 4,813,153 | A | 3/1989 | Palmer et al. |
| 4,876,436 | A | 10/1989 | Ide et al. |
| 4,882,852 | A | 11/1989 | Kautto |
| 4,882,992 | A | 11/1989 | Schmoeger |
| 4,992,866 | A | 2/1991 | Morgan ..... 358/108 |
| 5,010,659 | A | 4/1991 | Treleven |
| 5,060,572 | A | 10/1991 | Waizmann |
| 5,092,059 | A | 3/1992 | Wimberger et al. |
| 5,099,586 | A | 3/1992 | Anderson |

(Continued)

OTHER PUBLICATIONS

Printing Research, Inc., , "AB Air Blanket IR Dryer," One Page Brochure, (Oct. 30, 1999).

(Continued)

*Primary Examiner*—Henry Bennett
*Assistant Examiner*—Camtu Nguyen
(74) *Attorney, Agent, or Firm*—Conley Rose, P.C.

(57) ABSTRACT

A computer controlled power saving automatic zoned dryer for a printing press has a dryer head facing the substrate travel path, having a multiplicity of IR lamps connected individually or in groups to form a plurality of heating zones running longitudinally and each extending laterally side by side across the substrate travel path. The radiant heat output of each heating zone is controlled separately by means of a control unit connected to a power supply. The control unit individually regulates output of the heating zones. Unneeded zones are turned off to reduce cost of power and conserve energy. A plurality of heat sensors spaced laterally across the substrate path measure the surface temperature of substrate heated areas corresponding to the heating zones being operated and maintain an automatic set point temperature. The temperature of each individual heated area can be regulated automatically by adjusting the output of its heating zone whereby printed substrates having a more even temperature profile are delivered. In an alternate manual mode any zone can be set independently to operate at any percentage of full available power from zero to 100%. Separate high velocity air scrubbers and additional air extraction are used to enhance the total drying effect of the zoned dryer assembly.

27 Claims, 10 Drawing Sheets

U.S. PATENT DOCUMENTS

| | | | | | |
|---|---|---|---|---|---|
| 5,115,741 | A | | 5/1992 | Rodi | |
| 5,135,122 | A | | 8/1992 | Gross et al. | 219/10.55 |
| 5,142,795 | A | | 9/1992 | Abbott | |
| 5,168,811 | A | | 12/1992 | Cox et al. | |
| 5,369,894 | A | | 12/1994 | Schaffer et al. | |
| 5,440,821 | A | | 8/1995 | Hamrin | |
| 5,502,788 | A | | 3/1996 | Platsch | |
| 5,537,925 | A | | 7/1996 | Secor et al. | |
| 5,797,329 | A | * | 8/1998 | Okada | 101/488 |
| 5,937,535 | A | | 8/1999 | Hoffman, Jr. et al. | 34/78 |
| 5,937,761 | A | * | 8/1999 | Buschmann et al. | 101/424.1 |
| 5,953,833 | A | * | 9/1999 | Rudd | 34/528 |
| 6,088,931 | A | | 7/2000 | Aylor et al. | |
| 6,125,759 | A | * | 10/2000 | Epps | 101/484 |
| 6,283,590 | B1 | * | 9/2001 | Peter | 347/102 |
| 6,505,557 | B2 | * | 1/2003 | Desaulniers et al. | 101/487 |

OTHER PUBLICATIONS

Printing Research, Inc., "AB II Dryer, Operation and Maintenance Instructions: Series 9600, cover page, pages 1–10, 12, 13, 22 and copy of bar code on back bearing date of Apr. 18, 2000," believed to have been distributed in 1998.

* cited by examiner

POWER SAVING AUTOMATIC ZONED DRYER APPARATUS AND METHOD

FIELD OF THE INVENTION

The invention lies in the field of dryers for printing presses which operate to regulate temperature of printed substrate sheets with differing ink coverage.

BACKGROUND OF THE ART

Rotary offset printing presses reproduce an image on a substrate comprising successive sheets of paper or a web of paper by means of a plate cylinder which carries the image, a blanket cylinder which has an ink transfer surface for receiving the inked image, and an impression cylinder which presses the paper against the blanket cylinder so that the inked image is transferred to the paper. Lithographic inks applied to the paper can be partly absorbed and dry mainly by oxidation. Such inks are strong relative to other inks, do not contain aqueous solvents and generally have a very high solids content. Drying of lithographic inks can be enhanced by oxidation at somewhat elevated temperatures.

Many modern presses employ a coating or "lacquer" unit at the end of the press which can employ flexographic, ultraviolet (UV) or aqueous based coatings or printing inks quite different from lithographic printing ink. One example is a coater/printer made by Printing Research, Inc. illustrated in U.S. Pat. No. 5,176,077. In addition, coating equipment has been made for use with one of the regular lithographic printing stations on a printing press. These include retractable interstation coating units which permit flexographic, UV or aqueous based coatings and/or printing to be done at any desired station on a printing press in addition to the last station. Examples of such coating equipment produced by Printing Research, Inc. are illustrated in my U.S. Pat. Nos. 5,960,713, 5,651,316 and 5,598,777.

When conveyed through a printing press, freshly printed sheets are delivered to a stacker where they are collected and stacked. The wet ink and coating should be dried before the sheets are stacked to prevent smearing defects and to prevent offsetting and "gas ghosting" of the ink on the unprinted or printed side of the sheets which may occur when one sheet is stacked on the next sheet. Spray powder is usually applied to freshly printed sheets to be stacked for the purpose of preventing offsetting of freshly printed sheets. The use of spray powder is not desirable for other reasons. It can cause a rough feel to the printed surfaces of sheets and builds up on plates and blankets where it can interfere with good printing quality. This causes more frequent shutdowns to wash plates and blankets and is also detrimental to press components. The present invention reduces or eliminates the need for spray powder. Although spray powder can prevent offsetting while the ink and/or coating dries, this is only a partial solution to drying problems at best. In the case of flexographic, UV and/or aqueous based coatings or printed images which have relatively heavier wet film thicknesses, auxiliary drying before stacking is a necessity because of the difficulty of drying heavy wet ink films, especially aqueous based inks or coatings.

Hot air convection heaters and radiant heaters have been employed in dryers after printing and coating stations on printing presses. These are best suited for slow to moderate speed press runs in which exposure time of each printed sheet to the hot air convection flow is long enough that aqueous based inks and coatings are set before the sheets reach the stacker.

For high speed press operation, for example, at 5,000 sheets per hour or more, good drying is not generally obtained by convection flow alone. Improved dryers have been produced which employ infra-red heat lamps to provide greater drying efficiency because the short wave length infra-red energy is preferentially absorbed in the liquid inks and coatings to promote rapid drying. Infra-red radiant energy releases water and volatiles from the inks and/or coating. Scrubbing the printed surface with high velocity air further promotes drying. An example of a dryer that functions using a combination of high energy infra-red heat lamps together with high velocity air and extraction of the spent volatiles and water vapor is found in an infra-red dryer described in my U.S. Pat. No. 5,537,925 sold by Printing Research, Inc., which is incorporated herein by reference. This equipment in modified form is utilized in the present invention.

One of the problems with some prior art infra-red (IR) dryers is the fact that they must extend the fill width of the substrate width capacity of the press and they generally operate by off-on control. All of the heating tubes in the dryer are turned on when the press is printing and turned off when the press is stopped. If the press is printing a job where the substrate is less than the full width of the printing press, lamps in the IR dryer are being powered in areas where no substrate is being heated under them. This is no small matter, because powerful IR lamps are being employed to accommodate faster press speeds. In the incorporated U.S. Pat. No. 5,537,925, the lamps were each 1 kw lamps. In the preferred embodiment of the present invention, the lamp power consumption has been increased to 2 kw and there may be as many as 33 or more of these lamps in a dryer head. If, for example, a 24 inch sheet is run through a 40 inch press with such a dryer, 8 inches on each side does not need to be heated because there is no substrate there and no ink to dry. This kind of prior art dryer will continue to apply power across the full 40 inch (102 cm) width with a corresponding waste of expensive electricity and generation of unnecessary heat in the press and the pressroom.

One prior art dryer is an improvement to the typical all lamps on or all lamps off configuration of most prior art printing press dryers. It is known as the Air Blanket Infra Red Dryer sold by Printing Research Inc. which is the commercial embodiment of the dryer disclosed in my U.S. Pat. No. 5,537,925. The outer lamps are wired in groups of two, but the centrally located lamps are connected to operate as a single group of lamps. There may be two or three of the outer groups of lamps which operate in pairs. For example, the two left side outermost lamps and the two right side outermost lamps can be turned on or off together. The next two pairs of lamps on the left and right can be turned on and off together. There may be a third group of paired lamps. These paired lamps (two on each side) are connected to a selector switch which enables the operator to turn off two lamps on each side, four lamps on each side or six lamps on each side. This helps to save energy but the main group of lamps in the center is not affected and still operate together as one large group subject only to off-on control. Importantly, none of the groups of lamps in this prior art design, nor any individual lamp, is independently controlled in response to the temperature of the sheet. Power to the prior art dryer mentioned above is fixed by a selector switch and/or rheostat device and must be set initially and reset manually if the operator perceives that printed sheets are coming off too hot or too cold.

In addition, it is known that areas containing only text may require little or no drying whereas areas containing heavy coverage need considerably more drying power. There also may be non-printed areas which are devoid of any printing, have very little printing or have a kind of printing which does not require drying at all. One example of this may be "work and turn" jobs where one half of the sheet has process colors and the other half has text. After printing the first side, the sheets are turned over and run back through the press where the printing is repeated on the other side. The area which has only text, requires very little drying and with prior art dryers, has been subjected to high intensity radiation twice. Another example is the use of IR dryers on two color presses where four color jobs have to be run through the press two or more times. Areas not having ink are subjected to intense IR energy which may remove too much moisture and dry out the sheets. This can also affect register if one part of the sheet has more moisture than another part. Although the cost of energy is high in this country, there are a number of foreign countries where electrical energy costs three to four times as much as it does here. The energy savings is significant.

It is also a desirable goal to try to maintain the substrate temperature at a slightly elevated but uniform temperature across the surface measured at different points across the width and down the length of the substrate sheets. Powerful infra-red energy is applied from lamps operating at 120 to 480 volts. Despite attempts to moderate the effect of such intense radiation, temperature variation in the sheet continues to be a problem which is exacerbated when the sheets are stacked such that heat cannot readily escape and heat build up in the stack can occur. Some heat build up in a stack occurs naturally as a result of the oxidation process in lithographic inks. Nonuniform temperature can affect moisture content and a tendency for curling of the sheets. High temperature areas can increase the tendency for offsetting and sticking/blocking of sheets. This dryer helps prevent blocking. Temperature non-uniformity is believed to occur because the printed sheet has varying amounts of ink with different colors in different areas which absorb more or less infra-red radiant energy. Areas which are mostly white may not absorb as much of the infra-red energy with a resulting lower temperature in that area of the sheet. On the other hand, heavily printed areas with a dark color such as black, may readily absorb greater quantities of infra-red heat energy thus raising the temperature of the sheet nonuniformly. The present invention is directed to the reduction of energy cost and solution of these printing problems.

SUMMARY OF THE INVENTION

The invention may be regarded generally as a radiant energy dryer assembly having a plurality of heating zones which supply radiant energy to separate parts of printed sheets and have temperature sensors which sense the temperature of the printed surface and make adjustments to the outputs of the heated zones to produce a more uniform temperature profile in the printed substrate sheets. These sensors are also referred to as "heat sensors". Any heating of the zones can be turned off or turned down to save energy costs. The power saving automatic zoned dryer assembly is adapted for use in either a sheet fed or web fed offset printing press having printed substrate sheets being conveyed along a substrate travel path in a longitudinally extending direction with respect to the press. The invention can be used on other kinds of printing presses including rotogravure and flexographic presses, too. The invention could even be applied over a conveyor where painted or lithographed articles or parts are moving along the conveyor.

The dryer is mounted facing the substrate travel path, which is normally positioned above the substrate passing under the dryer, but could also in an appropriate installation be located below the substrate travel path where the printing to be dried is on the bottom side, for example. The dryer has a plurality of heating elements defining a plurality of longitudinally extending side-by-side heating zones facing the substrate. The heating zones preferably comprise a multiplicity of infra-red (IR) lamps connected individually or in groups to form a plurality of heating zones, each zone running longitudinally and extending laterally across part of the travel path. The longitudinally extending side-by-side heating zones facing the substrate create a plurality of longitudinally extending heated areas side-by-side on the substrate, each heated area corresponding to an area heated by exposure to one of the operating heating zones.

The operator is able to input the width of the job to be printed into a touch screen or other human machine interface which is easily programmed to determine that some of the heating zones outside the actual width of the substrate should be turned off and not further operated during the printing run. In addition, the operator can select any other zones which are turned off manually over areas where there are substantial areas of text or no printing on the substrate. By turning off the heating zones in areas such as these, the operator is able to save energy costs, avoid overheating the substrate in the lightly printed or no printing areas and introduce less heat into the press and pressroom operating environment. In the automatic mode, the zones which are operated are regulated with temperature sensors and a control unit. Regulated temperature across all zones is able to reduce sheet temperature variation. By producing a more uniform temperature across the substrate, the tendency for "blocking" is reduced.

In order to control printed substrate temperature in the manual mode, zones over areas with heavy ink coverage may be operated at a different power level than are zones with light ink coverage. Whether this will be a higher power or a lower power is determined by the IR absorption character of the different inks and coverages and the kind and weight of substrate material being printed In manual mode, the operator can input into the touch screen a percentage of full power that is available for any zone. Thus he can set one zone at one percentage of full available power and any other zone at a different percentage of full power. The zones in manual will operate at the set power level.

Heat sensors are preferably provided for each of the plurality of heated areas on the substrates, the heat sensors generating a signal indicative of the substrate temperature of the heated area. The heat sensors are preferably located offset downstream, with respect to the direction of the movement of printed sheet, just behind the heating zones. A control unit is provided which is capable of regulating the output of each of the plurality of heating zones in response to the signals generated by the heat sensor for the heated area corresponding to one of the plurality of heating zones whereby the temperature of the heated areas on the substrate can be controlled to approximate a desired set point temperature. In the preferred embodiment, a total of twelve heating zones are provided although the exact number of heating zones is a matter of design choice which in an appropriate situation might be as few as four or less or a number greater than 12. Since the zones create heated areas which may be described as bands which run longitudinally the full length of the sheet but which represent only a portion of the width of the sheet, a greater number of zones across the width of the sheet provides a greater opportunity for control of the heated areas which can be thought of as imaginary bands running longitudinally down the sheet.

The heating zones of the controlled zone dryer assembly are associated with a housing having a plenum chamber and preferably a source of pressurized air that is controllably directed onto the printed substrates passing under the dryer to aid in drying the printed surface. The pressurized air preferably passes over the IR lamps whereby the air is heated and the lamps are cooled somewhat. The pressurized air is preferably directed onto the printed surface by means of orifices that create pressurized high velocity jets which tend to scrub the printed surface upon which the radiant energy is directed. In a preferred embodiment, heated pressurized air is directed uniformly across the sheet ahead of the controlled zone dryer assembly and high pressure jets of ambient temperature air are directed at the printed surface of the substrate sheets after the zoned dryer assembly. A "Vent-A-Hood" extractor is preferably mounted over the delivery stack and optionally connected to "windows" in the press delivery containing the press delivery equipment, to remove moisture laden air. Extraction of moisture laden air from the press delivery windows can also be accomplished by means of a separate extractor.

Pressurized air is also preferably provided to housings in which the temperature sensors are located and mounted to prevent dust or spray powder from interfering with operation of the sensors by reducing deposits of such materials on sensor sensing surfaces. Since the operating environment at this portion of the typical press is replete with finely divided particles of materials such as starch, the prevention of blinding of the sensors by such deposits is important to avoid erratic results and unnecessary maintenance. The preferred sensors rely upon transmission of radiation and do not touch the sheet.

It is often desirable to produce a relatively uniform temperature profile across the sheet in every band of heated area. Some areas of the sheet absorb more radiant energy because of the color or density of the ink coverage. Absent control of one or more heating zones which radiate that area of the sheet, the sheet temperature could rise undesirably. The control unit links the sensors and controllers which adjust the output of the heating zones in response to signals generated by the heat sensor in the area or areas heated by that zone or zones which radiate the area of the substrate that is absorbing more radiant energy. This results in a change of the voltage or current (power) going to the IR lamps in a continuing sensing and adjusting cycle which is done by a single loop controller handling one zone, or preferably a dual loop controller which can handle two zones. Multiple loop controllers could also be used to control the zones. The zones can all be controlled by the sensors to a single set temperature or individual zones can be selected to be controlled at a different set temperature for that zone. For example, the outermost heating zones could be set to control at a temperature that is 7% to 15% higher than the centrally located heating zones to overcome an "edge effect" due in part to absence of an adjacent heating zone on one side edge of the outermost heating zone.

The control unit includes an input and monitoring device, preferably a touch screen controller which receives operating parameters from the operator and sends data to the programmable controllers including temperature set points for the heated areas (bands). The controllers are loop controllers, preferably dual loop controllers, having a feedback control loop responsive to the signal generated by the heat sensors for controlling output from the plurality of heating zones. The touch screen is adapted to receive data representative of the width of the substrate and in cooperation with the programmable controllers, deactivate heating zones in side areas beyond the substrate width. The operator can also use the touch screen to turn off any other heating zones that are not needed for a particular job. Alternatively, these can be separate switches to turn off unneeded heating zone lamps. In addition, the control unit may include a programmable logic controller operably connected to the touch screen. This controller may control operation of auxiliary blower motors for the dryer, temperature sensors, and an extractor which is preferably mounted at the opposite side of the substrate from the dryer. The extractor is designed and adapted to extract volatile materials and moisture that have been removed from the surface of the printed sheet as it is dried. The job being done by the touch screen controller, the dual loop controllers and programmable controller or controllers could be a single computer or combination of computers and/or controllers. The term touch screen controller is preferably a display with symbols that are touched by an operator. Touch screen could also have a touch pad.

The present invention saves energy. It eliminates or greatly reduces the need to use spray power. By drying under temperature control, independent separately controlled dryer zones create a more uniform temperature profile across the printed sheets without under or over drying some areas of the sheet. Better and more complete drying makes it possible to turn two pass printing jobs around and print again more quickly without waiting downtime. The risk of blocking is reduced because drying of all printed areas of the sheet is more uniform. Better moisture control in the printed sheets results in an improvement in sheet quality and better handling in subsequent operations. The invention should be considered broader than the preferred embodiment. The power saving automatic zoned dryer apparatus could be applied to any conveyor operation where articles to be dried are moved along a path, such as a conveyor for articles, parts or sheets that have been painted or lithographed.

DETAILED DESCRIPTION OF THE PREFERRED EMBODIMENT

As used herein, the term substrate refers to printed sheets or printed web stock. The term heated area refers to an area on the substrate heated by an individual zone and may also be referred to as a band, an imaginary band or a heated band. The heated areas run the full length of the sheet in the longitudinal direction of the press and are segmented laterally as individual bands or strips lying adjacent to each other across the width of the substrate. Enough heating zones should be provided to cover the full width of the substrate.

Figure 1:
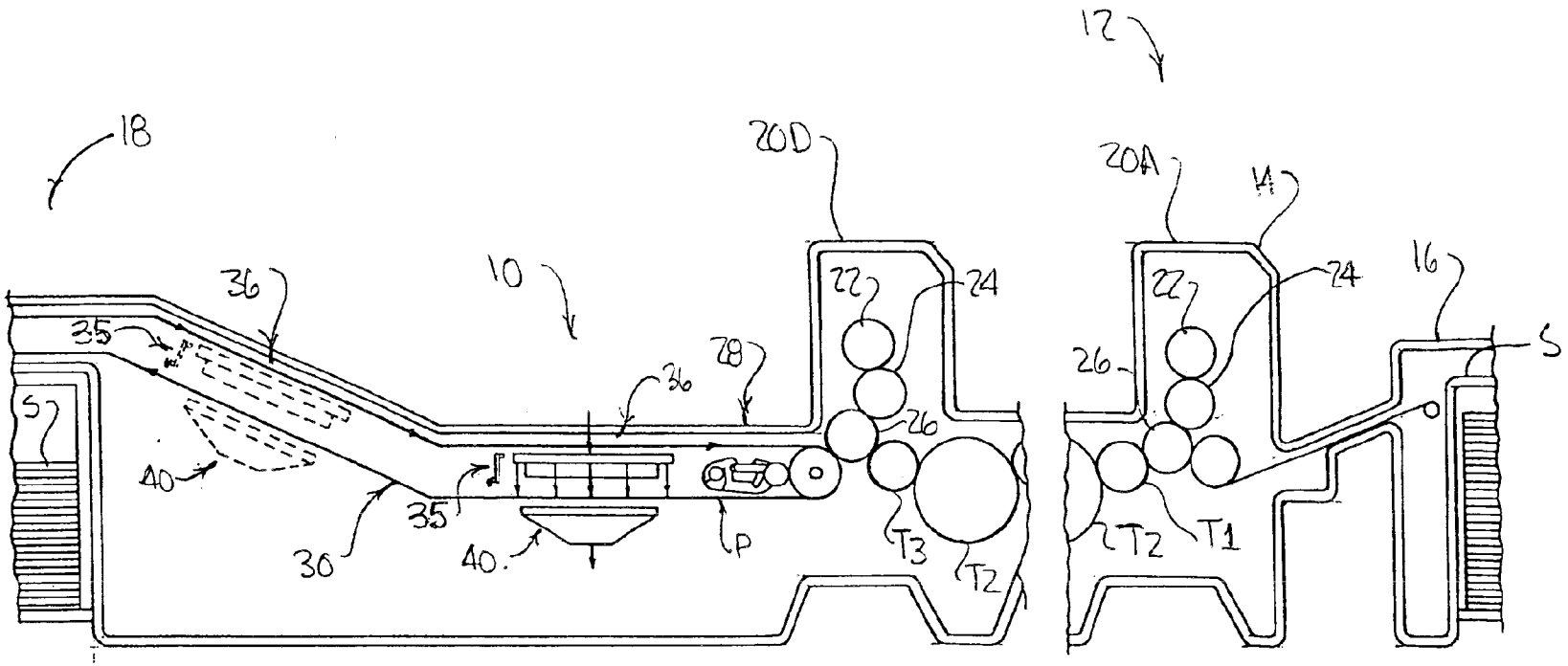
FIG. 1 is a schematic side elevation view in which the dryer assembly of the present invention is installed in a multicolor offset rotary printing press; showing an alternate location for the dryer assembly in dotted outline.

Referring now to FIG. 1, the dryer assembly 10 of the present invention will be described as being used for drying freshly printed substrates, either sheets or web stock, which have a protective and/or decorative coating or printing which has been applied in a sheet-fed or web-fed, rotary offset, rotogravure, flexographic printing press or even in digital printing. In this instance, dryer 10 of the present invention is mounted on the guide rails of the delivery conveyor of a multicolor printing press 12 and with brackets on the press frame. Press 12 may be a variety of different presses, but a typical press may be capable of handling approximately 40" (102 cm) wide stock capable of printing up to as much as 10,000 sheets per hour or more. This disclosure is based upon such a press as an example of how the dryer can be used.

Figure 12:
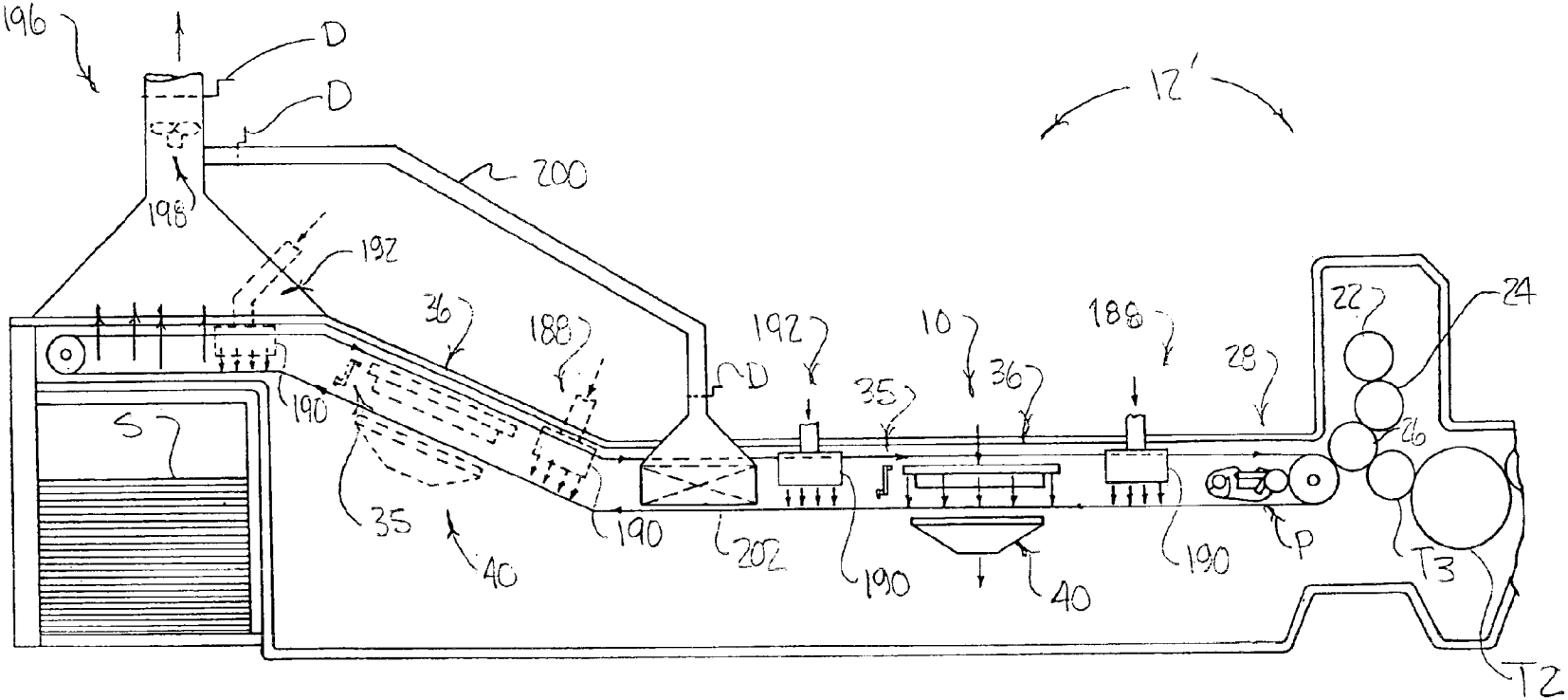
FIG. 12 is schematic side elevation view showing the dryer assembly of the present invention installed in combination with preceding and following optional high velocity air dryers and an optional Vent-A-Hood extractor in dotted outline installed over the delivery stack to pull moisture laden air from the press delivery, with alternate locations for the high velocity air dryers shown in dotted outline.

Press 12 includes a press frame 14 coupled on the right end to a sheet feeder 16 from which sheets designated S are individually and sequentially fed into the press 12. At the opposite end, is sheet delivery stacker 18 in which the finally printed sheets S are collected and stacked. Interposed between sheet feeder 16 and delivery stacker 18 are four substantially identical sheet offset printing units indicated as 20A through 20D, only two of which are shown. This is a four color printing press which can print different colored inks onto the sheets as they are transferred through the press. The invention is independent of the number of printing stations in a particular press. FIG. 1 shows a basic installation of the power saving automatic zone dryer apparatus on a lithographic printing press having a coating applicator. FIG. 12 shows a preferred embodiment on an extended delivery end section of a lithographic printing press having a coating applicator in which additional high velocity air is applied to the printed surface before and after the zone dryer. FIG. 12 also preferably includes a Vent-A-Hood exhaust system which removes moisture laden air from the press box.

As illustrated in FIG. 1, each sheet-fed printing unit 20A–20D is of conventional design, each unit including a plate cylinder 22, a blanket cylinder 24 and an impression cylinder 26. Freshly printed sheets from the impression cylinders 26 are transferred to the next printing unit by transfer cylinders T1, T2, and T3. The freshly lithographically printed sheets coming from printed unit 20D are protectively coated by means of a coating unit 28 which is positioned between the last printing unit 20D and the dryer assembly 10. Coating unit 28 is disclosed in my U.S. Pat. No. 5,176,077, which is incorporated herein by reference. This is not meant to be the exclusive coating unit with which the invention is used. Many presses have a built-in coating units and coating unit such as disclosed in my patents mentioned in the Summary of the Invention may be employed to provide heavy wet films on the lithographic printed substrate.

Figure 2:
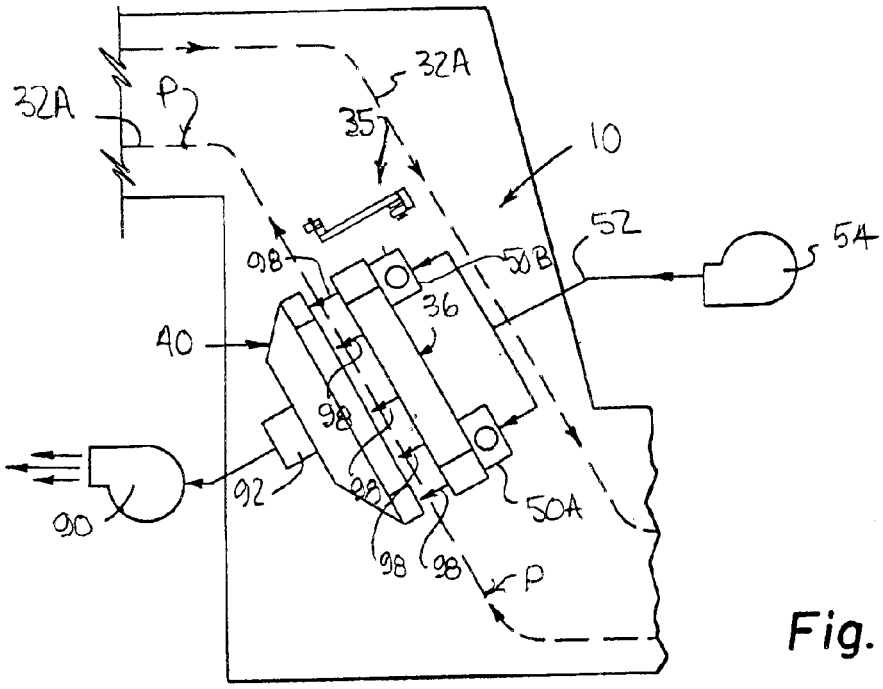
FIG. 2 is a simplified side elevational view showing installation of the dryer and an extractor in an alternate location in the delivery conveyor section of the printing press of FIG. 1.
Figure 3:
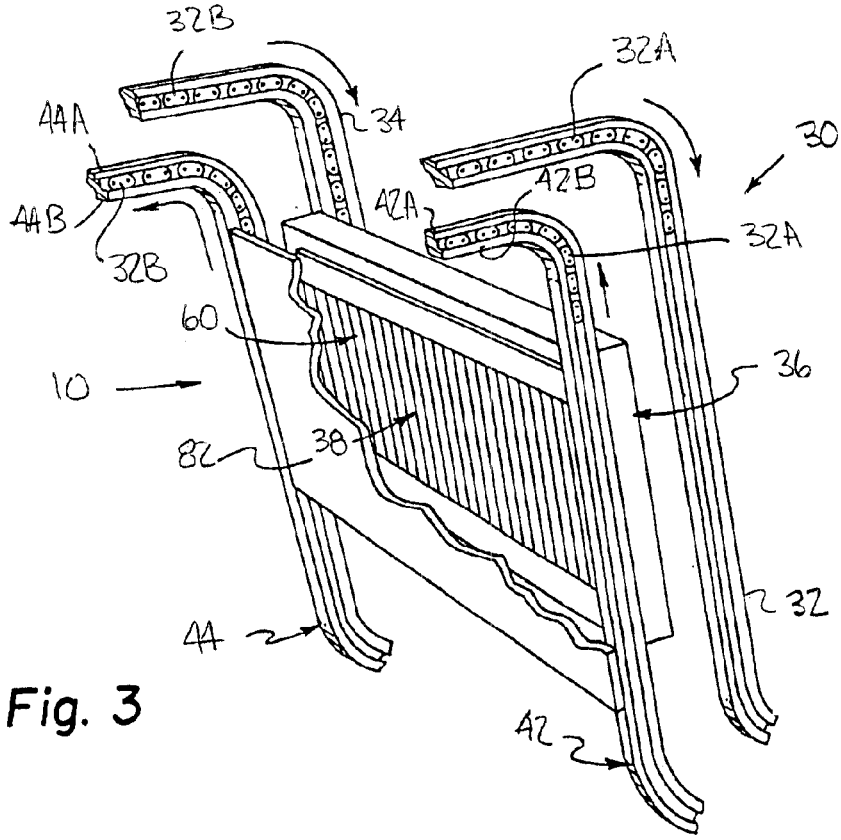
FIG. 3 is a perspective view, partially broken away, showing installation of the dryer assembly of FIG. 2 with respect to gripper chain rails which convey the printed sheet.

The freshly printed and coated sheets as are conveyed to the delivery stacker 18 by a delivery conveyor system generally designated by the reference 30. Referring now to FIG. 1, FIG. 2, and FIG. 3, delivery conveyor 30 is of conventional design and includes a pair of endless delivery gripper chains 32A, 32B shown which carry laterally disposed gripper bars having a gripping element for gripping the leading edge of each freshly printed sheet S as it leaves the impression cylinder 26. As the leading edge of the printed sheet S is gripped by the grippers, the delivery chains 32A and 32B pull the gripper bar and sheet S away from the impression cylinder and transport the freshly printed and coated sheet to the delivery stacker 18.

Prior to delivery to the sheet delivery stacker 18, the freshly printed sheets are dried by a combination of infra-red thermal radiation, forced airflow and extraction. Referring now to FIGS. 1–3 and FIG. 8, the dryer 10 includes as its principal components the dryer head 36, a radiant heat lamp assembly 38, an extractor head 40 and a plurality of heat sensors 35. These components may be mounted in any convenient alternate location such as indicated by the dotted outlines in FIG. 1. As shown in FIGS. 2 and 3, dryer head 36 is mounted on the upper section 42A of a chain guide rail 42, and likewise on the upper chain guide section 44A of a chain guide rail 44. In this position, dryer head 36 is extended across and spaced from the sheet travel path P which extends longitudinally through the press. As used herein, longitudinal means the machine direction and transverse means the cross machine direction.

Figure 8:
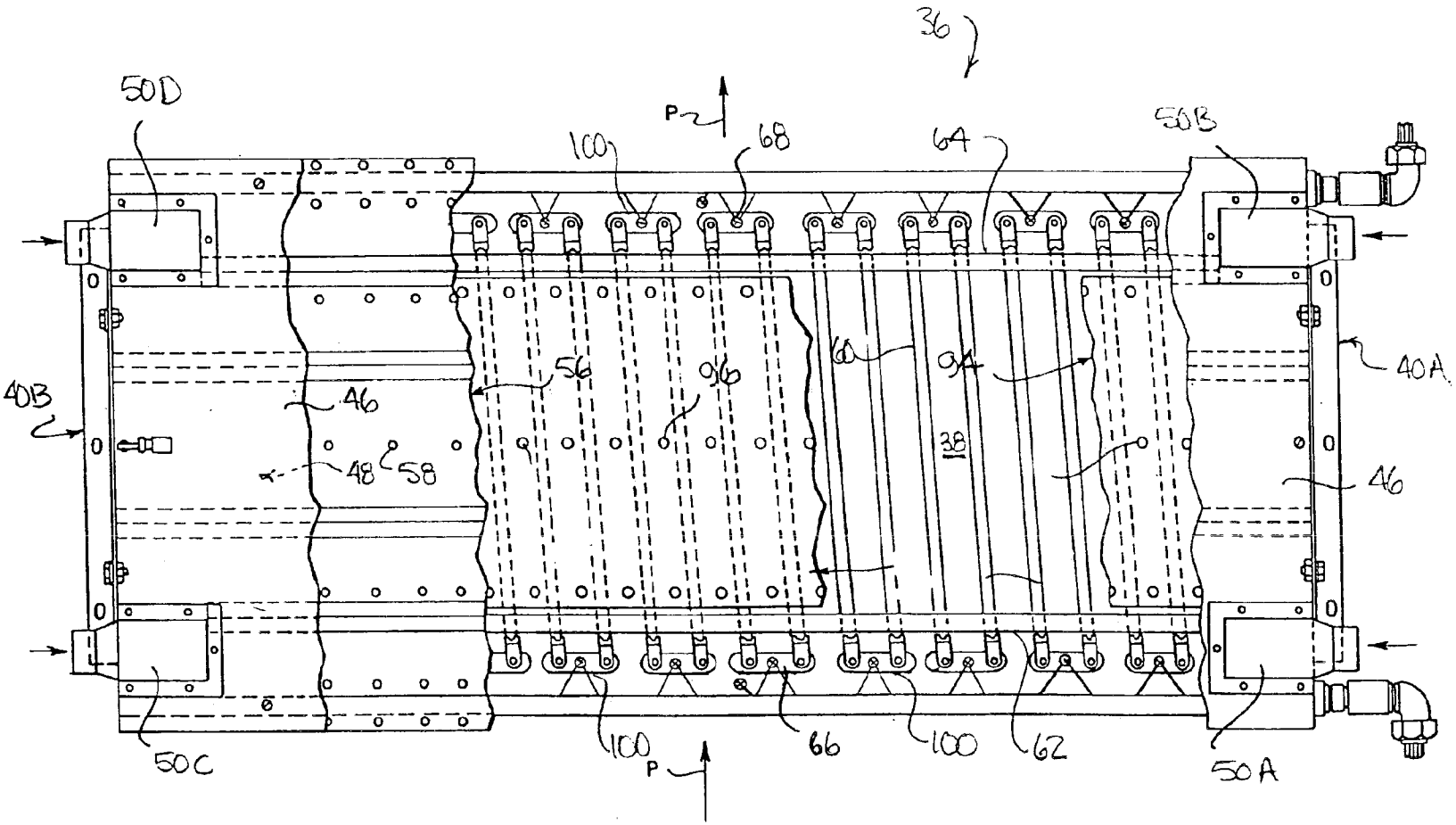
FIG. 8 is a top plan view, partially in section, of the dryer showing the heating element arrangement and air distribution system.

Dryer head 36 includes a housing 46 defining an air distribution manifold chamber 48. Air distribution manifold chamber 48 includes multiple inlet ports 50A, 50B, 50C and 50D for receiving pressurized air through a supply duct 52 from a blower fan 54. It may be supported by brackets 40A, 40B. As shown in FIG. 8, the air distribution manifold housing 46 includes a distribution panel 56 which is intersected by multiple discharge ports 58 oriented for discharging pressurized jets of air towards the sheet travel path. Discharge ports 58 are uniformly spaced so that a uniform blanket of pressurized air is produced across the process side of a sheet as it moves through the drying area. Additional heated pressurized air before and ambient pressurized air after the dryer head 36 is illustrated in FIG. 12 as a preferred embodiment.

Referring now to FIGS. 3 and 8, heat lamp assembly 38 includes an array of heat lamps 60 extending generally in the longitudinal direction generally parallel to the path of travel of the sheets passing through the press. Heat lamps 60 are preferably skewed to a small degree by moving one end laterally in cross machine direction to obtain more even heat distribution as the sheet moves longitudinally under the lamps. This avoids "hot spots" from concentrated heat which is more intense directly under the center of the lamps. Typically these lamps would be about 20 inches (51 cm) long, although they could be shorter or longer to accommodate particular needs.

Referring to FIG. 8, a reflector plate 94 is mounted intermediate air distribution panel 56 and heat lamp assembly 38. The reflector plate is intersected by multiple air flow apertures 96 which are disposed in air flow communication with the discharge ports 58 which are formed in distribution panel 56. The air flow apertures 96 are oriented to direct jets 98 of pressurized air through the heat lamp assembly 38 and onto a printed and/or coated (processed) sheet S moving along the sheet travel path. The sheet travel path P approximates the location of the lower gripper chains in the area of the guide rails 42, 44.

Sheet support plate 82 (FIG. 3) faces the radiant heat lamps across an exposure zone and is disposed substantially in alignment with the sheet travel path for engaging the back side of freshly processed sheet as it travels through the exposure zone between support or backing plate 82 and the array of heat lamps 38. The air extractor 40 in FIGS. 1 and 2 includes an exhaust blower fan 90 which communicates with extractor 40 through air duct 92. The air flow capacity of the exhaust blower fan 90 is preferably about 4 times the capacity provided by the first blower fan 54. This insures that the exposure zone between the backing plate and the lamps is maintained at a pressure less than atmospheric, thus preventing the escape of hot, moisture air laden into the press room.

The radiant heat lamps 60 as shown in FIG. 8 are supported between the sheet travel path and the air distribution manifold by end brackets 62, 64. The ends of each heat lamp project through circular apertures formed in the end brackets. Each heat lamp 60 includes electrodes which are electrically connected to power buses 66, 68 by flexible conductive straps. According to this arrangement, each heat lamp 60 is free to expand and contract longitudinally in response to thermal cycling. Each heat lamp 60 is preferably an infra-red radiant lamp having an output in a short-wave length (near) infra-red region (from about 0.70 to about 1.50 micrometers). The power dissipation of each infra-red lamp may be selected from a range of about 500–3 kw or even more. In the exemplary embodiment, each lamp is a short-wave infra-red quartz lamp having a electrical power rating of about 2 kw.

Further details of the extractor 40 and the air distribution system of the dryer head 36 are found in my U.S. Pat. No. 5,537,925 which is incorporated herein by reference. A difference in the assembly of FIG. 8 herein from the dryer shown in the patent is that lamps 60 are connected in pairs which are attached to individual conductors 100 rather than having some of them in pairs and some of them in groups as shown in U.S. Pat. No. 5,537,925. This is largely a matter of design choice in deciding how many lamps should be in each zone and how many zones will be provided. Although the preferred embodiment shows each zone having a pair of lamps 60, the individual zones could have fewer or more lamps and not all zones would have to have the same number of lamps.

The center bank of IR lamps in U.S. Pat. No. 5,537,925 operate as one integral unit. Except for lamps that have been switched off in the dryer shown in U.S. Pat. No. 5,537,925, all IR lamps come on or go off together whereas each pair of lamps (zone) in the present invention are individually powered and controlled. This enables the operator to save energy and avoid heating areas of the substrate sheets that don't need additional drying.

Figure 4:
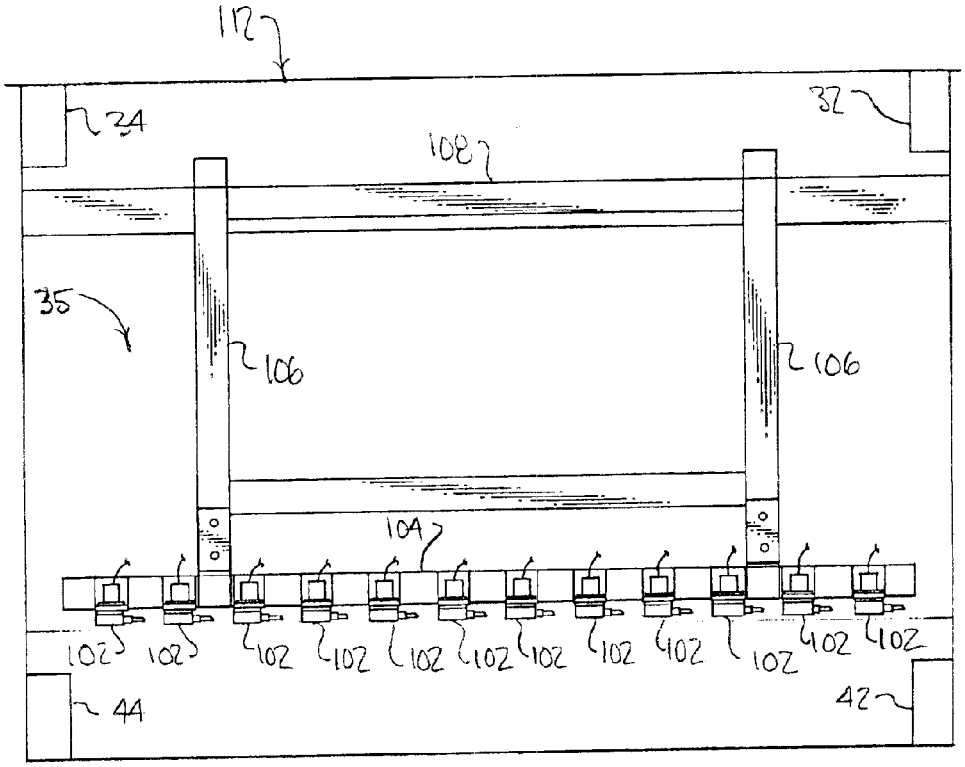
FIG. 4 is a frontal elevation view showing a supporting structure for the heat sensors which generate signals used to separately control the individual heating zones in an exemplary 12 zone system.
Figure 5:
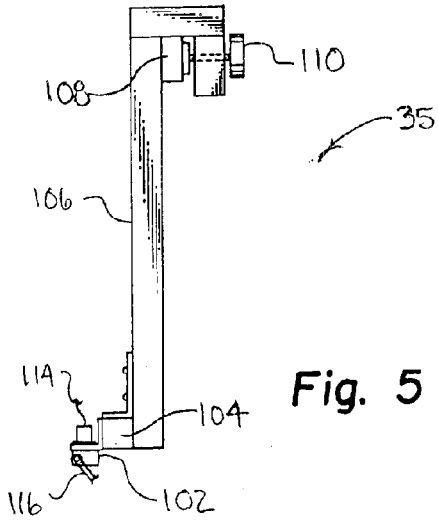
FIG. 5 is a side elevation view of the supports for the heat sensors of FIG. 4.

Referring now to FIGS. 4 and 5, the plurality of sensors 35 comprise infra-red sensors 102 spaced transversely across the substrate in the cross machine direction. Each of the sensors 102 are attached to a horizontal bar 104 extending transversely spaced above the substrate and supported by a pair of vertical bars 106. Vertical bars 106 are movably clamped to another horizontal bar 108, parallel to bar 104, by means of a clamping mechanism 110 which allows side to side adjustment of the array of sensors 102 and removal of the assembly for maintenance. In a typical press, the entire delivery conveyer 30 and the other parts including the dryer are contained in an enclosure 112 with removable access panels. The general position of the gripper chain guide rails 32, 34, 42 and 44 are schematically shown at the corners of box 112. Each of the heat sensors 102 has a electrical connection 114 and a pressurized air connection 116.

Figure 6:
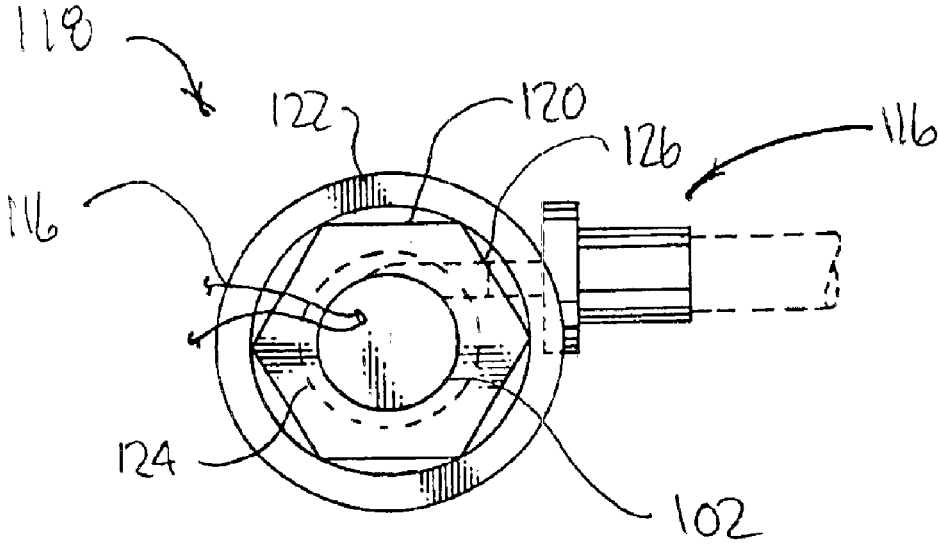
FIG. 6 is a top view of one of the individual heat sensors shown in FIGS. 4 and 5 together with a housing and a pressurized air connection.
Figure 7:
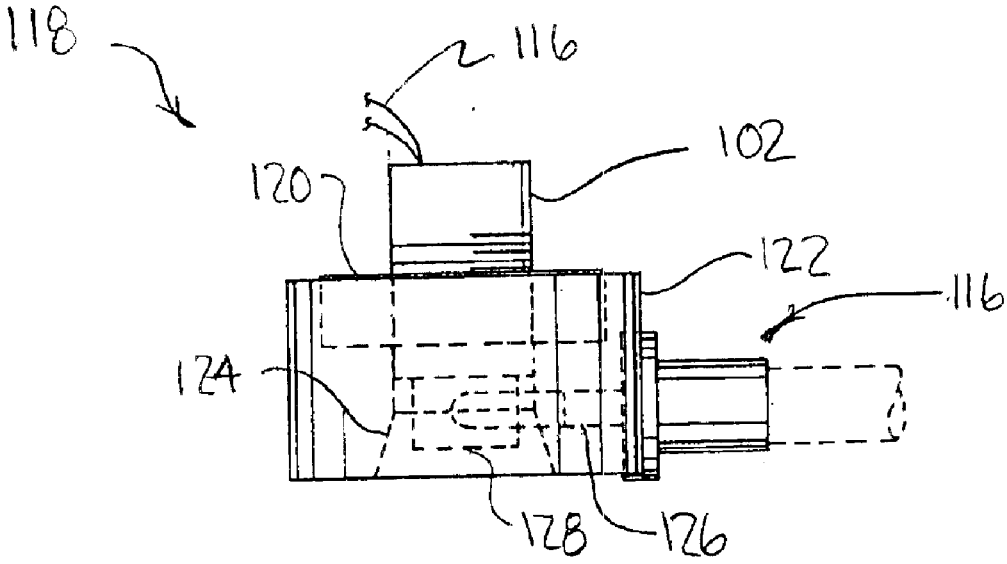
FIG. 7 is a side elevation of the sensor and sensor housing shown in FIG. 6.

FIGS. 6 and 7 are enlarged views of heat sensor assembly 118. Heat sensors 102 are mounted in assembly 118. Sensors 102 maybe threaded with a nut 120 jammed in a housing 122. Both the nut 120 and the housing 122 maybe made of an appropriate plastic material because they are not directly subjected to the heat of the infra-red lamps. Housing 122 includes a chamber 124 having an outwardly tapered opening and a radially offset passageway 126 which is connected to pressurized air connection 116 which introduces air in the chamber 124 by means of passageway 126. This arrangement produces a swirling pattern in the pressurized air which tends to keep finely divided starch particles from blinding lens 128 of heat sensor 102. The clean air also tends to cool the sensors. The sensors preferably depend upon infra-red radiation from the sheet surface to generate a signal represented of the temperature of the surface of the printed sheet. As mentioned before, spray powder may be introduced into the press environment in an attempt to prevent offsetting and "blocking" of sheets when they are stacked. There may be dust to contend with. The goal of the air distribution system is to use clean air to try to keep the powder or dust from blinding the heat sensors. The invention could employ other kinds of sheet temperature measuring devices as sensors.

Figure 9:
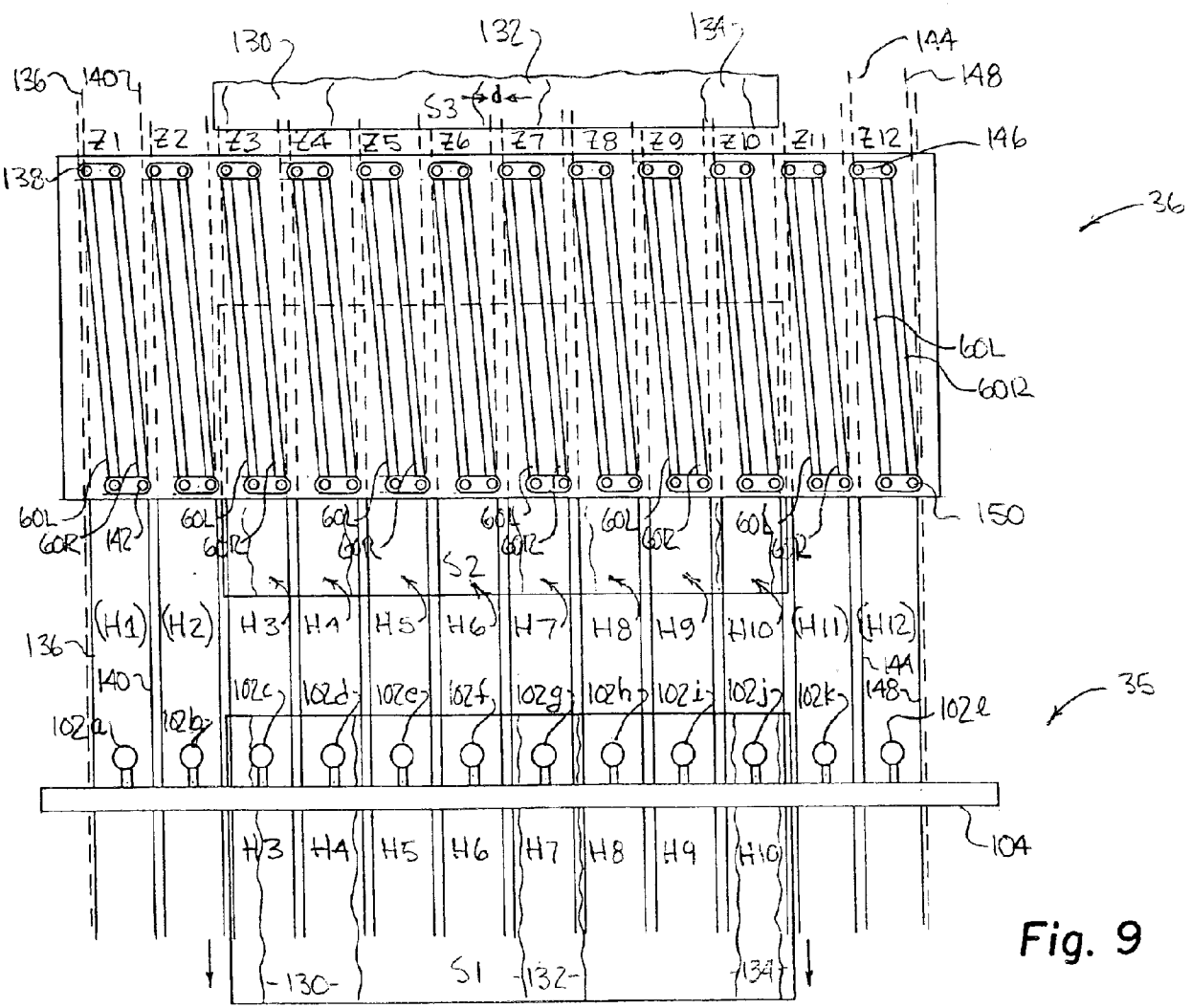
FIG. 9 is a schematic plan view looking down on the controlled zones dryer in operation showing the heating zones, heated zones, sensors and printed sheets having variable print coverage passing under the dryer head and then the array of sensors.

FIG. 9 is a schematic plan view looking down on the dryer assembly 10 part of press 12 showing layout and operation of the dryer head 36 and the array 35 of heat sensors. A succession of printed substrate sheets S1, S2 and S3 are shown moving under the heating head 36 and the array of heat sensors 35. Sheet S3 is just about to enter under dryer head 36, sheet S2 is just emerging from under dryer head 36 and sheet S1 is passing under the array of heat sensors 35. Areas of heavy ink coverage are identified as areas 130, 132 and 134 on sheet S1 and each of the other sheets have the same corresponding ink coverage since they are all being printed in the same process. These represent areas that might have substantially different radiant IR energy absorption than other areas of the sheet.

Dryer head 36 has a plurality of heating elements 60L, 60R extending generally longitudinally and forming a plurality of heating zones Z1–Z12 facing the substrates. As mentioned before, each pair of heating lamps 60L (left) and 60R (right) are angled or skewed slightly to provide even coverage as the sheets pass under the heating zones. Each heating zone extends transversely across part of the substrate path. Heating zone Z1 will be used to exemplify the boundaries of all of the other heating zones Z2–Z12. The left boundary 136 of heating zone Z1 is represented by the dotted line extended upwardly in FIG. 9 from the upper end 138 of lamp 60L of Z1. The right boundary of the heating zone Z1 is established by extending the dotted line 140 from the lower end 142 of lamp 60R of zone Z1. The other heating zones are defined in the same way. For example, the boundaries of heating zone Z12 are defined by the dotted line 144 running through the upper end of the lamp 60L of heating zone Z12 and dotted line 148 running through the lower end 150 of heating zone Z12. Dotted line 144 is the left boundary and dotted line 148 is right boundary of heating zone Z12. The right and left boundary zones of all of the other zones Z2–Z11 are determined in exactly the same manner. It is understood that the right and left boundaries (136, 140) and (144, 148), for example, are not sharp demarcations since the lamps are spaced above the substrate S1–S3 and the radiation spreads out as it reaches the substrate such that there is some overlapping at the edges in the area represented by the area "d" between heating zones Z6 and Z7, for example. The spacing "d" is preferably obtained by positioning the pairs of lamps in each zone so that the best uniformity of temperature on the substrate below is obtained. The heating zones Z1–Z12 are meant to constitute the primary side by side areas of full width substrates below which are heated by the lamps of a given zone and controlled to a set temperature. Sufficient zones should be provided to cover the widest substrate.

Heating zones Z1–Z12 are further represented by heated areas H1–H12 indicated by the side by side areas between the solid lines as longitudinal bands below dryer head 36 as sheets S1–S3 move in the longitudinal direction towards the bottom of FIG. 9. Heated areas H3–H10 in FIG. 9 represent those bands as a continuation of the dotted lines which define the right and left boundaries of the zones Z3–Z10 on the surface of the substrate S2 and also on the previous substrate S1. The parenthesis around the heated zones H1, H2 and H11, H12 are meant to indicate the position where the heated zones would be if the substrates S1–S3 were the full width of dryer head 36 and those zones were turned on. In the situation represented by FIG. 9, there would be no actual heated zones H1, H2 and H11, H12 because zones Z1 and Z2 corresponding to heated areas H1 and H2 and the zones Z11 and Z12 corresponding to heated areas H11 and H112 would be turned off during operation since there is no substrate below the two outside zones. Their energy consumption is saved.

The array of heat sensors-connected to support bar 104 in FIG. 9 are labeled 102*a*–102*l* from left to right for convenience. Each sensor 102 is set to read the surface temperature of a heated zone on the surface of the printed sheets S1–S3 as they pass beneath sensor array 35. In contrast to prior art infra-red dryers, including the dryer in U.S. Pat. No. 5,537,925, the control unit of the present invention is able to independently and separately adjust the temperature of each heated zone H1–H12 in response to signals generated by the corresponding sensors 102*a*–102*l*.

In the example of FIG. 9, the areas 132, 134 have more energy absorbing ink or a color that absorbs more energy. These heated areas H7 and H10 are controlled respectively by sensors 192*g* and 102*j* working to regulate respective heating zones Z7 and Z10. Without this control, areas 132, 134 might be at a nonuniformly higher or lower temperature going into the stack than other areas of the substrate with different kinds or quantities of ink coverage. Area 130 is meant to show that two heat sensors 102*c* and 102*d* can work together with their heating zones Z3 and Z4 to regulate a wider area of greater radiant energy absorption. It is also contemplated that there could be heat sensors that cover a wider heated area which could provide a signal that regulates more than one zone. For example, one heat sensor might be used to regulate two heating zones. In an extreme case, if areas 130, 132 and 134 were the only printed areas, the operator could selectively turn off all but zones Z3, Z4, Z7 and Z10 to save energy consumption and avoid overheating or over drying the sheet in the areas where there is no printing. This can be done through the touch screen by means of separate switches.

Figure 10:
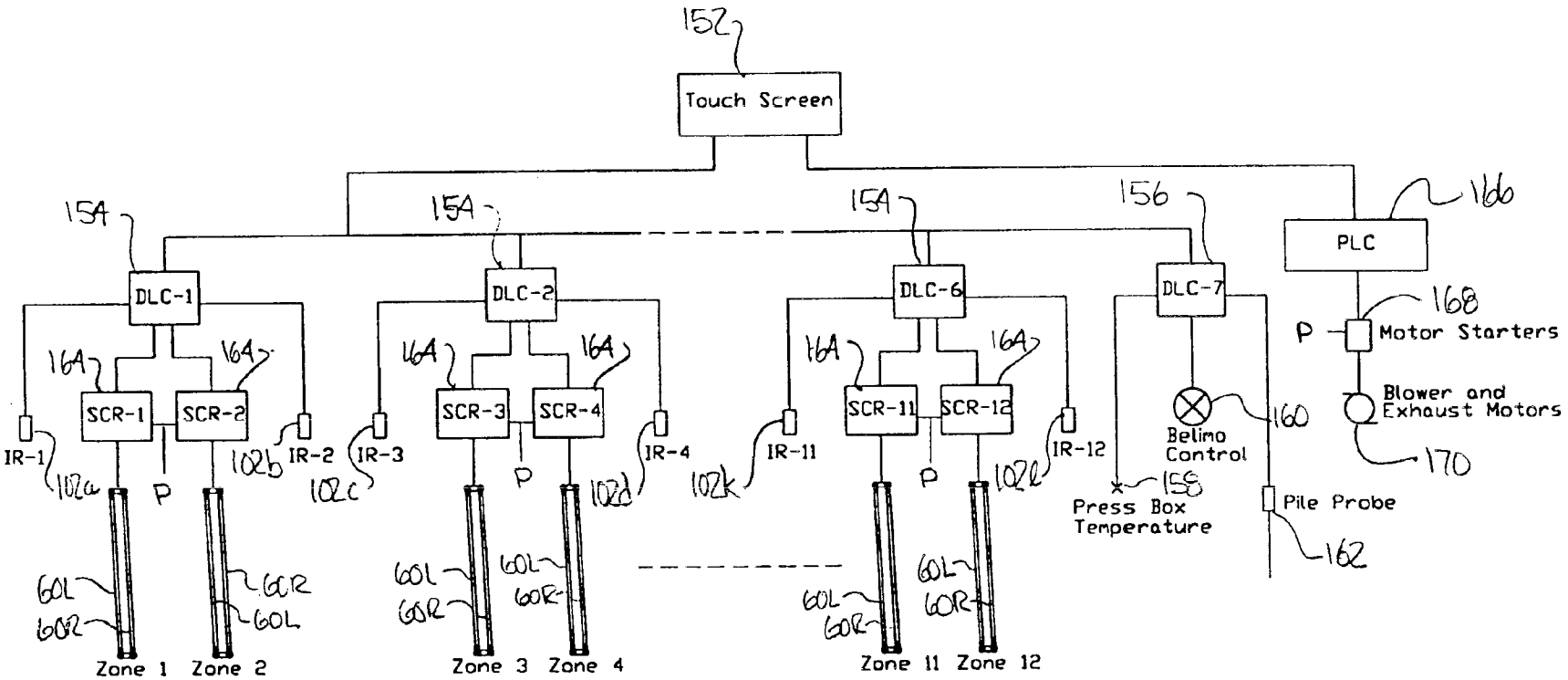
FIG. 10 is a schematic layout drawing showing interconnection of principal components of the controlled zones drying assembly.

FIG. 10 shows how the pair of lamps 60L, 60R for each zone are connected to control and power control elements comprising a control unit capable of regulating the output of each of the plurality of heating zones (Z1–Z12) in response to signals generated by a respective heat sensor for the heated areas (H1–H12) corresponding to ones of the plurality of heating zones. Human machine interface (HMI) comprising touch screen computer 152 is connected electrically to each of preferably six dual loop controllers designated DLC-1–DLC-6 which are given the reference numeral 154. There may be more or less of the dual loop controllers depending on the number of zones and what the application requires. The system preferably includes an additional dual loop controller 156 designated DLC-7 to handle auxiliary items. Dual loop controller 156 may control such things as press box temperature thermocouple 158 which measures ambient air temperature inside the press. It may also control a "Belimo"™ damper control 160 for air flow to head 36 and a temperature probe 162 to allow the operator to measure the temperature of the pile of stacked sheets at the delivery end of the press. The dotted lines in the center represent omitted DLC-3, DLC-4 and DLC-5 which are connected in exactly the same way with their respective heating zones Z3–Z5 as are the controllers 154 shown.

Each controller 154 controls two zones. For example, controller DLC-1 controls zone 1 and zone 2 and receives input signals generated by a sensor 102*a* (IR-1) for zone 1 and a sensor 102*b* (IR-2) for zone 2 as shown in FIG. 9. Power is supplied to the IR lamps of each zone through solid state control relays 164 which are designated SCR-1 through SCR-12 in FIG. 10, one for each zone. The SCR's actually regulate the voltage to the IR lamps from an external power source indicated by the symbol "P" connected to the SCR's. The SCR's in turn are connected to the IR lamps. Other conventional power connections are not shown in the interest of clarity.

Each dual loop controller 154 sends control signals to two of the solid state control relays 164. Each SCR adjusts power supplied to the pair of lamps it is connected to, comprising one heating zone. Each pair of lamps constitutes a zone which is controlled separately and independently from each of the other zones. The power supply to the lamps of each zone as indicated by the symbol "P" is at a voltage of 120 volts or 480 AC volts depending upon the power available at a job site. The power is preferably three phase power with care taken in connecting the lamps to balance the load so that the load is fairly uniform on each leg of the three phase power circuit. IR lamps, which are operated in single phase, are selected accordingly.

The control unit may also include a programmable logic controller 166 designated PLC which may be programmed for control through its connection to touch screen 152 to operate motor starters 168 for blower and exhaust motors, such as blowers or fans 54 and 90, which supply air to dryer head 36 or extract air from extractor 40.

Figure 11:
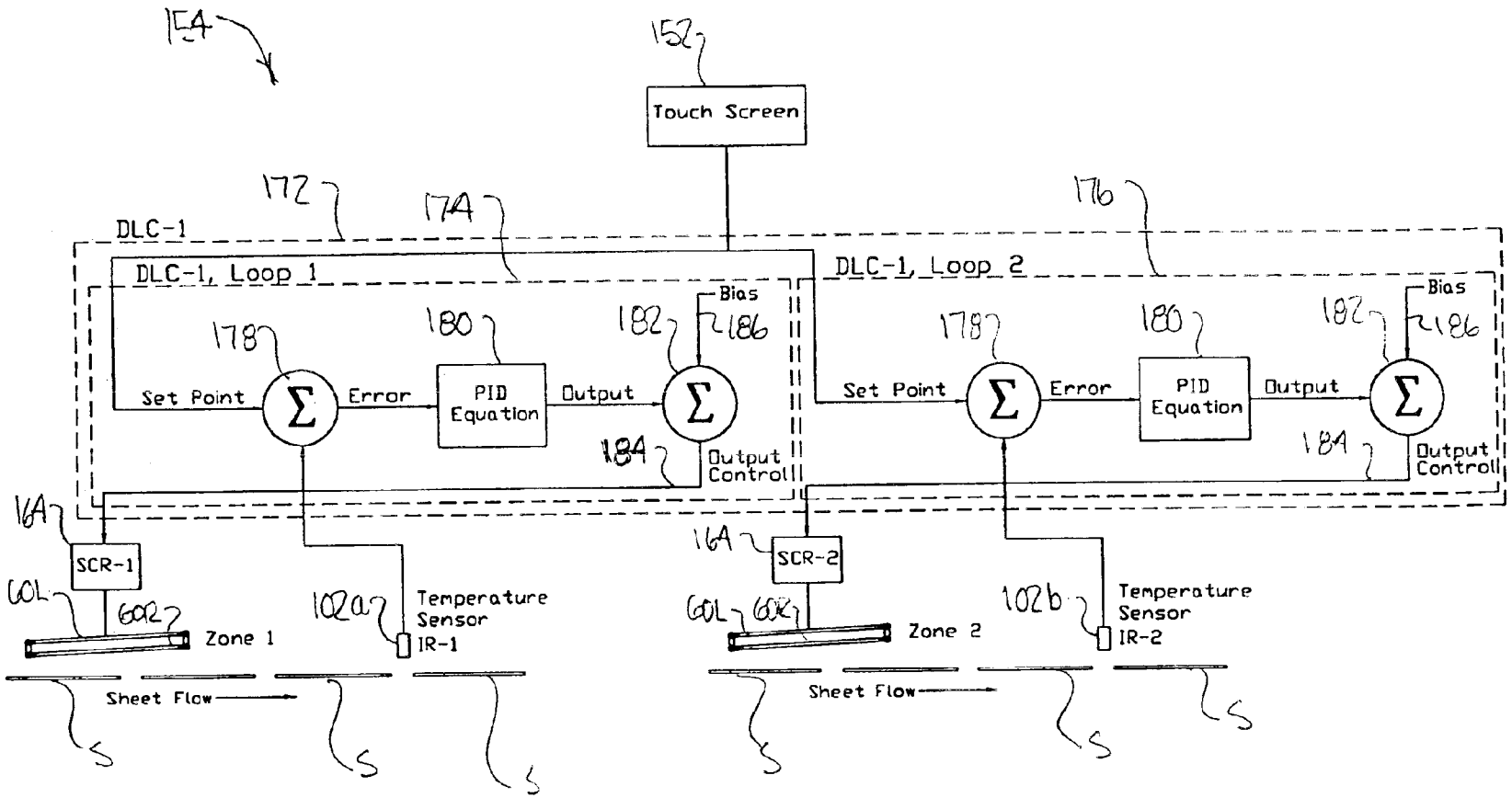
FIG. 11 is a diagram showing the operation of the principal components of FIG. 9 to control heated zone temperatures.

FIG. 11 isolates one of the dual loop controllers 154 from FIG. 10. Dual loop controllers 154 and 156 are programmable computers which include two feedback loops or loop controllers in a single device. Both of the control loops are contained in the dotted line box 172 whereas loop 1 for DLC-1 is contained in the dotted line box 174 and loop 2 for DLC-1 is contained in dotted line box 176. Temperature control of the zones is monitored and controlled through touch screen 152 which is more generally a human machine interface (HMI), not necessarily just a touch screen. After initializing the system upon powering up, the operator may input the width of the substrate and touch screen computer 152 determines which zones should be inoperative and which zones are to be selected for operation based on that width. Touch screen 152 applies a control signal to the appropriate dual loop controller 154 to turn off the outermost lamps of zones that are not being used because they are located outside the width of the substrate.

In manual mode the operator may also set by means of touch screen 152 a percentage of power to be applied to all or to individual ones of the zones which are to be active for the press run he is about to make. In manual mode the operator might select a percentage from roughly 40% to 100% of available power output. Other zones can be manually selected to receive no power at the operators discretion. In automatic operation the operator can set a single set point temperature for all zones or different set point temperatures for selected zones. Some zones can be shut off to save energy. Zones can be shut off manually through the touch screen. These can be any of the zones.

Once the operator has selected a set of conditions to run a particular job, he can save the settings as a program or "recipe". This can include selections of set temperatures of any zone and whether any particular zone is to be on or off for that job. He can override the zone selections automatically made in automatic mode based on sheet width operator input data. He can also turn off zones anywhere IR heat is not needed. Then when the same job comes up again, the operator can activate the program through the touch screen controller to re-establish his preferred settings. He can also make changes to the settings during the run and save the changes to the program or "recipe".

One main goal of the invention is to establish a uniform processed sheet temperature which is typically in the range of about 90–105° F. (32–41° C.). The temperature of the sheets in the stack typically would be about 95–110° F. (32–43° C.) or 115° F. (46° C.) for that sheet temperature. There is some temperature increase in the stack as a result of oxidation of the inks and the insulating effect of the delivery stack. It is also known that the weight of stock influences the amount of energy absorbed as well as the type and amount of ink coverage on the substrate. The touch screen can be programmed for both manual and automatic operation. In automatic operation, the operator inputs set temperature and variables associated with his particular press run which sets the initial conditions of the amount of power applied to the lamps initially and upon reaching an operating state after a period of time. All zones can be set to one temperature or selected zones can have a different set temperature. Set temperature is the temperature the control system for the lamps tries to maintain.

It is usually desirable to have the lamps of the dryer programmed to ramp up quickly to wide open at full power to help warm up faster. Once the individual zones are approaching the desired temperature, a "PID" equation (Proportional Integral Derivative) in the DLC's uses the input from the individual heat sensor for that zone in real time to adjust automatically the voltages being applied to the IR lamps for that zone to control the amount of sheet temperature overshoot or undershoot.

Each of the loops 174, 176 can be programmed individually in order to make the temperature in each heated zone as even and uniform as possible. One reason for this may be an edge effect which can occur on the outside edges where the last zone is adjacent to another heating zone on one side but there is no heating zone on the other side. This contrasts with the interior zones where each zone has another heating zone on both sides of the boundaries between the zones and the fact that the heat from one zone can affect another zone. For purposes of discussion, we will consider each loop to be programmed the same way to produce the same temperature in each heated zone.

In FIG. 11, the substrates S flow from left to right along a longitudinal path. The lamps 60L, 60R of zone 1 are supported longitudinally over sheets S and the temperature sensor 102*a* comprises an optical thermocouple which is suspended typically about 6 inches above the surface of printed substrates S. Heat sensor 102*a* generates a signal which is sent to loop controller 174. This temperature signal is compared with a set point temperature supplied to controllers 154 by touch screen 152 at block 178 as indicated by the symbol "sigma". If the temperature of the surface of the sheet in zone 1 is different from the required set point established by the operator, the difference is fed into block 180 which is programmed with a proportional integral derivative (PID) equation which generates an output which is transmitted to block 182. (An example of PD equation can be found on the web site www.isa.org/mcweb/contipid/0.2925.0.00.html of the American Instrument Society.)

Block 182 is programmed to generate an output control signal 184 after taking into account a bias 186. Bias 186 is a voltage which represents an offset temperature bias. Heat sensors 102 may tend to read a temperature that is too high. For example, it might read 28° F. (−2.2° C.) too high. The offset bias gives the system the opportunity to control the output in the form of a voltage or a current that is applied as a control signal to SCR-1. Bias 186 could also come via appropriate circuitry through a connection with another heat sensor 102 from another zone. This might occur where it was desirable to bias the temperature of one zone depending upon the temperature of another zone.

The final output 184 is a control voltage typically 0–10 volts DC. To control 0 to 480 volts at the lamps 60L, 60R of zone 1, 0–10 volts DC is standard for PID operation. Other control voltage ranges are available as well as control based on milliamps as standard analog signals versus a discrete control which is either on or off. The preferred PID monitored control avoids the problem of overshooting or undershooting substrate sheet surface temperatures produced by the powerful lamps. The loop controllers 154 preferably run the "PID" equation every 200 milliseconds but it could be done at 5 seconds or some other value. This is one of the input factors set with software through a computer connection with the controllers which is done once. Similarly, a ramp up and ramp down rate is set through the computer connection to determine how rapidly the output from block 180 should change as a result of a given error determined at block 178. The amount of ramping could be set at anything from a fairly low level to essentially a vertical ramp as a percentage. A vertical ramp would amount to off-on control. It is believed that a desirable ramp may be about 20% for a given amount of difference in the temperature error signal found at block 178. Ramping is a matter of experimenting with a given system to try to get the least practical amount of sheet temperature variation from the set point. It is believed that appropriate selection of the input variables to the DLC's can result in sheet temperature variation of only ±2 degrees or so from the desired temperature set points. The configuration in some PID devices could be set with dip switches, or some other conventional means.

FIG. 12 is a preferred embodiment showing the power saving automatic zoned dryer apparatus 10 installed on an extended delivery press 12', showing only the delivery end of the press after print station 20D. Reference numerals for the common parts from FIG. 1 are retained. It has been discovered that pre-heating the printed sheets with heated high velocity impingement air before they reach the zoned dryer accelerates drying of the printed substrate even more than with the zoned dryer alone. Impingement with ambient high velocity air after the zoned dryer is preferred also for an additional drying effect. In FIG. 12, a high velocity heated air chamber supply designated by reference numeral 188 is positioned after coater 28 and before zoned dryer 10. Heated air chamber supply 188 receives heated air from a source of heated air as indicated by the arrows and directs high velocity air through openings in the box 190 onto the printed surface of the sheets being transferred through the press. Air chamber box 190 extends in a cross machine direction and is at least as wide as the widest substrate to be printed. Another high velocity air chamber supply 192 supplied with ambient air directs high velocity ambient temperature air, as indicated by the arrows, by means of air chamber box 190. This air chamber box also extends across the full width of the printed substrate. These air chambers 188, 192 provide a supply of high velocity pressurized air to "scrub" the printed surface of the sheets.

Figure 13:
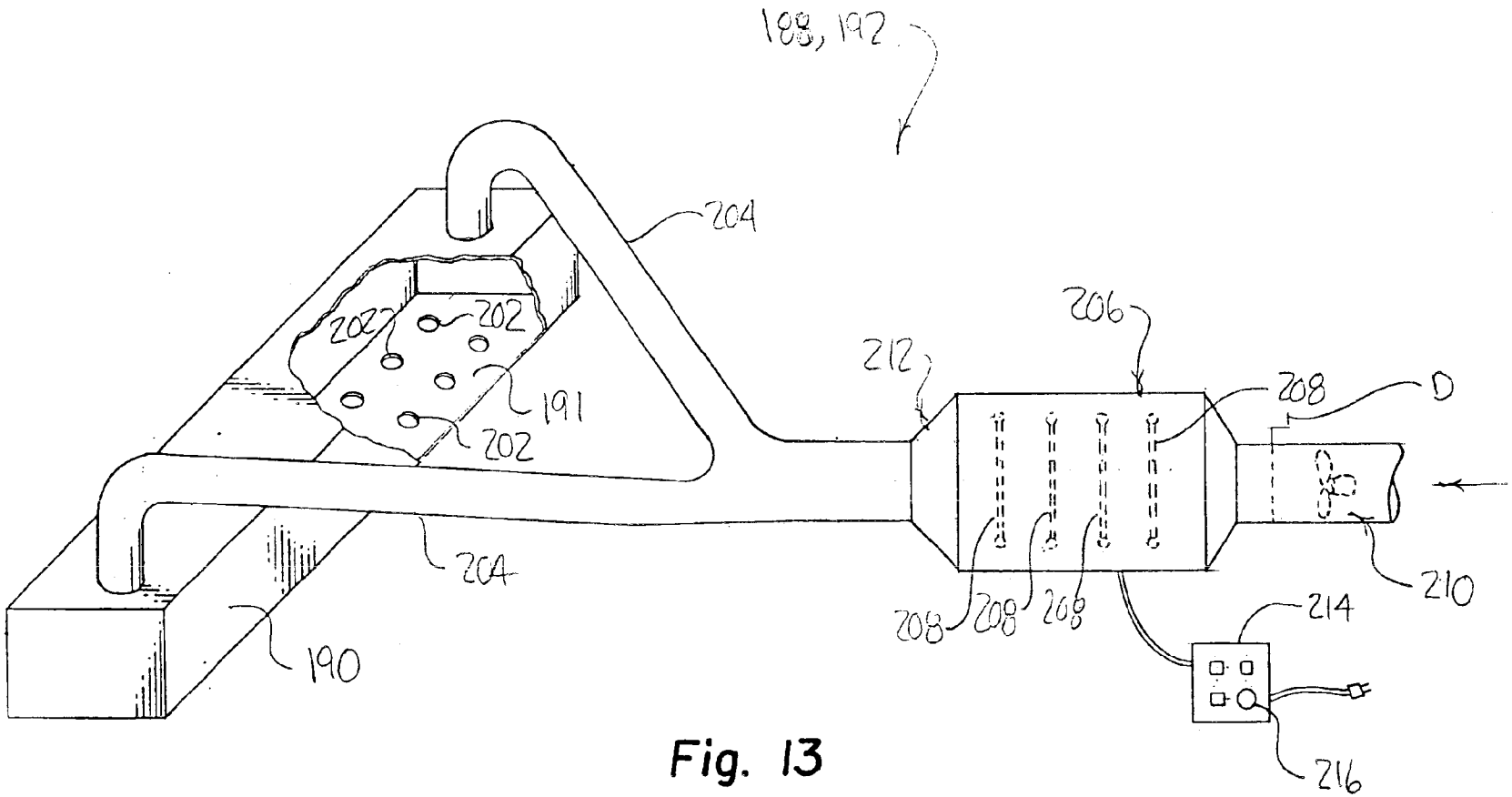
FIG. 13 is a schematic view of a heated air high velocity air dryer of FIG. 12.

An alternate location for the dryer head 36, extractor 40 and the preceding and following high velocity air chambers 188 and 192 are shown in dotted outline at the left side of FIG. 12. This type of arrangement would be applicable to short or standard delivery presses which are well known in the art. The high velocity air supplies 188, 192 act like scrubbers which remove the moisture laden air barrier or other gasses from the printed surface in combination with the inventive zoned IR dryer. Some details of a preferred construction of the high velocity air supplies 188, 192, are shown in FIG. 13. In addition, it is preferred to employ an extractor 196 commonly referred to in the industry as a Vent-A-Hood 196. Vent-A-Hood 196 has an exhaust blower 198 and a damper D, or other flow control device, which together with appropriate controls on the blower 198 can allow the operator to adjust the flow of air to avoid creating disturbing air currents which affect stacking or movement of the printed sheets. Vent-A-Hood 196 may be connected through a duct or flow passage 200 to a window 202 in the side of the press delivery which encloses the gripper chains. Extractor 196 and duct 200 may be provided with suitably controlled dampers D to balance the air to prevent fluttering or other undesirable sheet movement. Vent-A-Hood 196 contains air flow openings into the upper area of delivery stack 18. This allows hot air, as indicated by the arrows, to be removed from the delivery stack area in addition to moisture laden air being removed from the press delivery itself through side openings 202. These enhancements in connection with the power saving automatic zoned dryer apparatus help improve the drying of printed sheets on presses running at ever increasing speeds.

FIG. 13 is a schematic illustration of the simple air chamber box system for the high velocity air chambers indicated as 188 and 192. Box 190 is an enclosure having a bottom side 191 facing the substrate printed surfaces. The bottom side contains a plurality of perforations or openings 202 and one or more ducts 204 preferably leading to opposite ends of box 190 for balancing purposes. Ducts 204 are supplied with pressurized air by means of an additional enclosure 206 which contains a series of heating elements, such as Calrod™ elements 208. A blower 210 supplies clean air to enclosure 206 through a damper D. Heated air moves through an outlet 212. The heating elements are provided with a control cabinet 214 which may include a rheostat (potentiometer) 216 to adjust the power applied to the Calrod™ units thereby adjusting the temperature of the air being supplied by the blower. Ambient air supply 192 can be the same unit with the heaters turned off. Air may be fed into the ends of air chamber box 190 through ducts 204, or in any other suitable arrangement. It is contemplated that the velocity of the air will be controlled by means of the damper D rather than by variation of the speed of the blower 210, although that is possible as well. Hot air chamber 188 may typically operate at an air temperature of 240° F. (115° C.) in an effort to get air at around 120° F. (49° C.) to reach onto the surface of the printed sheet. There is a large loss of temperature in the air because of its rapid expansion and the cooling effect attendant thereto. Only air chamber box 190 is actually located within the press delivery system. The heater and control system is external to the press delivery system.

In the best mode, the heat sensor 102 is preferably a sensor identified as IRt/c.01 available from Exergen Corporation, 15 Water Street, Watertown, Mass. 02172 USA. This sensor is said to have a target temperature range from −50 to 550° F. (−45 to 290° C.) and operate at ambient temperatures up to 160° F. (70° C.).

The preferred dual loop controller 154, 156 is identified as Model No. DLC01000 which is available as an off the shelf item from Red Lion Controls at 20 Willow Springs Circle, York, Pa. 17402 USA. The controller has a RS 485 serial communication port and an adapter cable which converts the RS 232 port of the PC to RS 485 so that a PC can be used to program the controller. Although the dual controller is preferred because it reduces the number of controllers required to half the number of zones to be controlled, it should be understood that similar single loop or multiple loop controllers are available for the purpose of separately controlling each heating zone.

The preferred solid state control relay (SCR) 164 is a Model No. EP-1-20 which is available from Phasetronics, Inc., 13214 38$^{th}$ Street North, Clearwater, Fla. 33762 USA.

The preferred PLC controller 166 is an off the shelf item available from IDEC Corporation, 1175 Elko Drive, Sunnyvale, Calif. 94089 USA as Model No. FC3A-CP2K.

The preferred HMI 152 is a Model No. TX700 Color Touch Screen available from Red Lion Controls, 20 Willow Springs Circle, York Pa. 17402 USA. It also may be desirable to employ a lamp outage detector such as an AC current sensor which determines whether one or more of the IR lamps burns out. Other control features for the temperature control system are believed to be well known by one of ordinary skill in the art.

Although the invention has been described with particular reference to presently preferred embodiments thereof, it will be appreciated that various modifications, alterations, variations, etc., may be made without departing from the spirit and scope of the invention as defined in the appended claims.

What is claimed:

1. A power saving automatic zoned dryer assembly for a printing press having a substrate travel path, comprising:

a dryer head adapted for mounting in the printing press facing the substrate travel path, the dryer head having a multiplicity of IR lamps connected individually or in groups to form a plurality of heating zones, each zone running longitudinally along and extending laterally across part of the travel path, the IR lamps positioned to irradiate a surface of a substrate on the substrate travel path;

a power supply operably connected to the IR lamps in a manner that allows output of said IR lamps connected individually or in groups in each heating zones to be controlled separately;

a control unit connected to the power supply, the control unit being operable to individually adjust output of the IR lamps connected individually or in groups in each heating zones;

a plurality of sensors spaced laterally across the substrate path to generate signals indicative of temperatures of heated areas of the surface of substrates passing under the heating zones when the press is printing; and whereby the temperature of substrates in the travel path corresponding to areas heated by the heating zones can be adjusted and controlled by the control unit which adjusts output of the heating zones in response to the signals generated by said sensors while the press is printing.

2. The assembly of claim 1 wherein said plurality of heating zones comprise at least two heating zones, each having an output which is separately adjustable.

3. The assembly of claim 2 wherein at least some of the plurality of sensors are mounted in a housing which has an air supply for passage of air under pressure to prevent dust or spray powder from interfering with operation of the sensors.

4. The assembly of claim 3 wherein the air supply of the housing is offset to introduce swirling air around the sensor.

5. The assembly of claim 1 wherein the control unit includes one or more programmable controllers which receive the sensor outputs and adjust the heating zones to achieve a preselected desired set point temperature in the heated areas.

6. The assembly of claim 5 wherein the control unit includes an input and monitoring device which receives operating parameters from the operator and sends data to said one or more controllers, including the temperature set points, and monitors temperature in said heated areas of said heating zones as indicated by the sensors.

7. The assembly of claim 6 wherein the input and monitoring device is a touchscreen operably connected to programmable controllers comprising loop controllers having a feedback control loop for each of the multiplicity of IR lamps which regulate the IR lamps.

8. A power saving method of regulating temperature of printed or coated surfaces of substrates exposed to infra-red (IR) heating as they move along a substrate path in a printing press, comprising the following steps:

moving a succession of printed substrates along the substrate path;

providing an IR heater comprising a plurality of separately controlled IR heating zones, each zone running longitudinally along and extending laterally across part of the substrate path;

heating a plurality of longitudinally extending, laterally spaced heated areas on a surface of the printed substrates corresponding to the heating zones as the substrates pass under the IR heating zones of the IR dryer;

sensing the temperature of the heated areas of the substrate surface; and adjusting the output of the heating zones in response to the sensed temperature of the heated areas of the substrate surface corresponding to said heating zones.

9. The method of claim 8 wherein the step of heating a plurality of longitudinally extending, laterally spaced heated areas on the printed substrates corresponding to the heating zones includes the step of simultaneously scrubbing the surface of the heated areas with high velocity air.

10. The method of claim 9 further including the step of extracting spent high velocity air after it has scrubbed the heated areas.

11. The method of claim 8 further including the step of providing a supply of pressurized air; and scrubbing the printed or coated surface of the substrate sheets with high velocity air from said source.

12. The method of claim 11 wherein said source provides pressurized heated air and the surface is scrubbed with high velocity heated air from said source.

13. The method of any one of claims 8–12 further including the step of extracting air from the press delivery system.

14. The method of claim 8 wherein the step of providing an IR dryer includes setting desired set point temperatures for the heated areas and the step of adjusting the output of the heating zones comprises the step of making the sensed temperatures in each heated area approximate the desired set point temperatures by changing the output of one or more of the heating zones.

15. The method of claim 8 further including the step of establishing set point temperatures for the heated areas and wherein the step of adjusting the output of the heating zones is performed in a manner that regulates the temperature of the heated areas near the set point temperatures.

16. The method of claim 15 wherein said step of adjusting the output of the heating zones is performed in such a manner that the desired set point temperatures of the heated areas are regulated at about the same desired temperature.

17. The method of claim 8 wherein the step of providing a plurality of separately controlled IR heating zones includes establishing said heating zones across a width of substrate path in excess of the substrate width and the step of heating a plurality of heated areas on printed substrates passing under the IR dryer includes the step of operating only heating zones within the width of the substrates moving along the substrate path.

18. The method of claim 8 further including the step of passing air under pressure through the IR dryer to impinge on the printed substrates.

19. The method of claim 18 further including the step of providing a source of pressurized air across the substrate travel path; and impinging high velocity air upon the printed or coated substrate either before or after the heating step is performed.

20. The method of claim 19 wherein the source of pressurized air comprises heated air and the step of impinging the surface of the printed sheet with high velocity air comprises the step of impinging said surface with heated high velocity air.

21. The method of one of claims 19 or 20 wherein the method further includes an extraction step whereby air is extracted from the press delivery system.

22. The method of claim 18 further including the step of directing the air passing through the IR dryer to flow through the heating zones thereby healing the air before it impinging on the substrates.

23. The method of claim 8 wherein the step of sensing the temperature of the heated areas is performed by a plurality of sensors and further include the step of providing air under pressure to one or more of said sensors to prevent dust or spray powder from interfering with sensor efficiency.

24. The method of claim 23 wherein the step of providing pressurized air to one or more of said comprises the step of swirling the air to reduce deposits of dust or spray powder on sensor sensing surfaces.

25. A power saving method of regulating temperature of differentially heatable areas of surfaces of printed substrates exposed to infra-red (IR) heating as they move along a substrate path in a printing press; comprising:

moving a succession of printed substrates along the substrate path;

providing an IR heater head assembly spaced from the substrates, the heater head assembly having a plurality of IR heating zones with adjustable outputs, each zone running longitudinally along and extending laterally across part of the width of the substrates;

operating said plurality of IR heating zones while substrates are moving along the substrate path;

generating signals representative of temperatures of portions of the substrates corresponding to heated areas of the surfaces of the substrates passing under the IR heating zones;

adjusting and controlling output of the IR heating zones in response to said signals in order to selectively maintain temperature of the surface of the substrates passing under the IR heating zones within a desired range of temperature despite absorption of different amounts of IR energy in areas of the substrates passing under different heating zones;

whereby printed substrates having a more even temperature profile are delivered.

26. The method of claim 25 wherein the step of adjusting and controlling the output of the heated zones in response to signals representative of temperatures of substrates corresponding to heated areas of substrates passing under heating zones includes the step of periodically incrementing or decrementing the power supplied to the heating zones by an amount based upon the signals representative of the temperature of the printed substrates corresponding to heated areas of the substrates passing under the heating zones.

27. The method of claim 26 wherein the step of generating signals representative of temperatures of the substrates corresponding to heated areas of the substrates passing under the IR heating zones comprises the step of operating sensors positioned to sense a surface of the heated areas.

* * * * *

UNITED STATES PATENT AND TRADEMARK OFFICE

CERTIFICATE OF CORRECTION

PATENT NO. : 6,877,247 B1
DATED : April 12, 2005
INVENTOR(S) : Howard W. DeMoore It is certified that error appears in the above-identified patent and that said Letters Patent is hereby corrected as shown below:

Column 14,
Line 24, replace “PD” with -- PID --.

Column 18,
Line 61, replace “healing” with -- heating --.
Line 61, replace “impinging” with -- impinges --.
Line 65, replace “include” with -- includes --.

Signed and Sealed this

Fifth Day of July, 2005

JON W. DUDAS
*Director of the United States Patent and Trademark Office*